US007162172B2

(12) United States Patent
Grace et al.

(10) Patent No.: US 7,162,172 B2
(45) Date of Patent: Jan. 9, 2007

(54) SEMI-AUTOMATIC IMAGE QUALITY ADJUSTMENT FOR MULTIPLE MARKING ENGINE SYSTEMS

(75) Inventors: Robert E. Grace, Fairport, NY (US); Michael C. Mongeon, Walworth, NY (US); Hugh W. Griffith, Albans (GB); Krzysztof J. Less, London (GB); Tim D. M. Enskat, Oxford (GB)

(73) Assignee: Xerox Corporation, Stamford, CT (US)

( * ) Notice: Subject to any disclaimer, the term of this patent is extended or adjusted under 35 U.S.C. 154(b) by 142 days.

(21) Appl. No.: 10/999,326

(22) Filed: Nov. 30, 2004

(65) Prior Publication Data

US 2006/0115284 A1 Jun. 1, 2006

(51) Int. Cl.
*G03G 15/00* (2006.01)

(52) U.S. Cl. ..... 399/49

(58) Field of Classification Search ..... 399/39, 399/40, 49, 50, 51, 53, 55, 60; 358/504, 358/518

See application file for complete search history.

(56) References Cited

U.S. PATENT DOCUMENTS

| | | | |
|---|---|---|---|
| 4,579,446 | A | 4/1986 | Fujino et al. |
| 4,587,532 | A | 5/1986 | Asano |
| 4,710,785 | A | 12/1987 | Mills |
| 4,725,732 | A | 2/1988 | Lang et al. |
| 4,836,119 | A | 6/1989 | Siraco et al. |
| 4,965,679 | A | 10/1990 | Morton et al. |
| 5,004,222 | A | 4/1991 | Dobashi |
| 5,080,340 | A | 1/1992 | Hacknauer et al. |
| 5,095,342 | A | 3/1992 | Farrell et al. |
| 5,159,395 | A | 10/1992 | Farrell et al. |
| 5,185,673 | A | 2/1993 | Sobol |
| 5,208,640 | A | 5/1993 | Horie et al. |
| 5,272,511 | A | 12/1993 | Conrad et al. |
| 5,326,093 | A | 7/1994 | Sollitt |
| 5,347,369 | A | 9/1994 | Harrington |
| 5,435,544 | A | 7/1995 | Mandel |
| 5,461,462 | A | 10/1995 | Nakane et al. |
| 5,473,419 | A | 12/1995 | Russel et al. |
| 5,489,969 | A | 2/1996 | Soler et al. |
| 5,504,568 | A | 4/1996 | Saraswat et al. |
| 5,510,896 | A | 4/1996 | Wafler |
| 5,525,031 | A | 6/1996 | Fox |
| 5,539,522 | A | 7/1996 | Yoshida |
| 5,546,165 | A | 8/1996 | Rushing et al. |
| 5,557,367 | A | 9/1996 | Yang et al. |

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Hoang Ngo
(74) *Attorney, Agent, or Firm*—Eugene O. Palazzo; Fay, Sharpe, Fagan, Minnich & McKee, LLP

(57) ABSTRACT

Using a document scanner or other image input device of an image or document processing system to periodically scan or image printed test images from a plurality of marking engines replaces internal sensors as a feedback means in image quality control. For example, image lightness (L*) is controlled by periodically printing mid-tone test patches, scanning the printed test patches with a main job document scanner and analyzing the scanned image to determine updated marking engine actuator set points. For instance, ROS exposure and/or scorotron grid voltages are adjusted to maintain image lightness consistency between marking engines.

29 Claims, 5 Drawing Sheets

U.S. PATENT DOCUMENTS 5,568,246 A 10/1996 Keller et al.
5,570,172 A 10/1996 Acquaviva
5,583,644 A 12/1996 Sasanuma et al.
5,596,416 A 1/1997 Barry et al.
5,629,762 A 5/1997 Mahoney et al.
5,666,150 A 9/1997 Ajewole
5,710,968 A 1/1998 Clark et al.
5,721,623 A 2/1998 Boxma
5,729,786 A * 3/1998 Yamada et al. ..... 399/42
5,736,996 A * 4/1998 Takada et al. ..... 347/19
5,778,377 A 7/1998 Marlin et al.
5,859,933 A 1/1999 Sasanuma et al.
5,884,118 A 3/1999 Mestha et al.
5,884,910 A 3/1999 Mandel
5,995,248 A 11/1999 Katori et al.
5,995,721 A 11/1999 Rourke et al.
6,035,103 A * 3/2000 Zuber ..... 358/1.9
6,046,820 A 4/2000 Konishi
6,059,284 A 5/2000 Wolf et al.
6,125,248 A 9/2000 Moser
6,133,934 A 10/2000 Nakano
6,241,242 B1 6/2001 Munro
6,297,886 B1 10/2001 Cornell
6,341,773 B1 1/2002 Aprato et al.
6,384,918 B1 5/2002 Hubble, III et al.
6,418,281 B1 7/2002 Ohki
6,450,711 B1 9/2002 Conrow
6,476,376 B1 11/2002 Biegelsen et al.
6,476,923 B1 11/2002 Cornell
6,493,098 B1 12/2002 Cornell
6,537,910 B1 3/2003 Burke et al.
6,550,762 B1 4/2003 Stoll
6,554,276 B1 4/2003 Jackson et al.
6,577,925 B1 6/2003 Fromherz
6,607,320 B1 8/2003 Bobrow et al.
6,608,988 B1 8/2003 Conrow
6,612,566 B1 9/2003 Stoll
6,612,571 B1 9/2003 Rider
6,621,576 B1 9/2003 Tandon et al.
6,633,382 B1 10/2003 Hubble, III et al.
6,639,669 B1 10/2003 Hubble, III et al.
6,819,906 B1 11/2004 Herrmann et al.
6,925,283 B1 8/2005 Mandel et al.
2002/0078012 A1 6/2002 Ryan et al.
2002/0103559 A1 8/2002 Gartstein
2003/0077095 A1 4/2003 Conrow
2004/0085561 A1 5/2004 Fromherz
2004/0085562 A1 5/2004 Fromherz
2004/0088207 A1 5/2004 Fromherz
2004/0135878 A1 7/2004 Mizes et al.
2004/0150156 A1 8/2004 Fromherz et al.
2004/0150158 A1 8/2004 Biegelsen et al.
2004/0153983 A1 8/2004 McMillan
2004/0216002 A1 10/2004 Fromherz et al.
2004/0225391 A1 11/2004 Fromherz et al.
2004/0225394 A1 11/2004 Fromherz et al.
2004/0247365 A1 12/2004 Lofthus et al.

OTHER PUBLICATIONS

Desmond Fretz, "Cluster Printing Solution Announced", Today at Xerox (TAX), No. 1129, Aug. 3, 2001.

U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/001,890, filed Dec. 2, 2004, Lofthus et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al..
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/136,821, filed May 25, 2005, Robinson.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/166,763, filed Jun. 24, 2005, Thayer.
U.S. Appl. No. 11/166,961, filed Jun. 24, 2005, Moore.
U.S. Appl. No. 11/170,873, filed Jun. 30, 2005, Klassen.
U.S. Appl. No. 11/170,975, filed Jun. 30, 2005, Klassen.
U.S. Appl. No. 11/168,152, filed Jun. 28, 2005, German et al.
U.S. Appl. No. 11/170,845, filed Jun. 30, 2005, Sampath et al.

* cited by examiner

SEMI-AUTOMATIC IMAGE QUALITY ADJUSTMENT FOR MULTIPLE MARKING ENGINE SYSTEMS

BACKGROUND

There is illustrated herein in embodiments, methods and systems for adjusting image quality or image consistency in multiple printing or marking engine systems. Embodiments will be described in detail with reference to electrophotographic or xerographic print engines. However, it is to be appreciated that embodiments associated with other marking or rendering technologies are contemplated.

It is desirable, in the use of any system, for an output of the system to match some target or desired output. For instance, in image rendering or printing systems, it is desirable that a rendered, or printed, image closely match, or have similar aspects or characteristics to, a desired target or input image. However, many factors, such as temperature, humidity, ink or toner age, and/or component wear, tend to move the output of a rendering or printing system away from the ideal or target output. For example, in xerographic marking engines, system component tolerances and drifts, as well as environmental disturbances, may tend to move an engine response curve (ERC) away from an ideal, desired or target engine response and toward an engine response that yields images that are lighter or darker than desired.

To combat these tendencies, rendering systems or marking engines are designed with closed loop controls that operate to drive the engine response curve of a marking engine back toward the ideal or target response.

For example, optical sensors are used to sense the reflectance of multiple intra-image or intra-document halftone test patches. The resulting reflectance values are compared to stored reference or target values. Error values, resulting from these comparisons are used to adjust xerographic process actuators. This process is repeated until the errors are minimized, and performed on an ongoing basis in order to prevent or limit engine response curve variation.

Additional control loops are also employed. For instance, electrostatic volt meters are used to measure a charge (or a voltage associated with the charge) placed on a photoconductive belt or drum. The level of charge placed on the photoconductor is a factor in the amount of toner attracted to the photoconductor during a development process. A xerographic actuator, such as a corotron or scorotron wire voltage or a scorotron grid voltage, is controlled so that a measurement received from the electrostatic volt meter (ESV) is driven toward a voltage target or setpoint. The setpoint may be changed to darken or lighten an image.

Toner concentration (TC) sensors can sense, for example, magnetic reluctance associated with magnetic carrier particles, or a developer mixture, in a developer housing. When the toner concentration is high, the average spacing between the magnetic carrier beads is greater and the reluctance signal is lower. As the TC sensor magnetic reluctance signal changes, from a toner concentration/magnetic reluctance setpoint, the rate at which fresh toner is dispensed into the developer housing is changed. The amount of toner transferred to the photoconductor can be a function of the toner concentration in the developer housing. Therefore, changing the toner concentration in the developer housing may affect the lightness or darkness of a rendered or printed image. Therefore, the toner concentration/magnetic reluctance setpoint may be adjusted to lighten or darken an engine response curve or drive an engine response curve toward an ideal or desired position.

Using these sensors and the associated control loops is an effective approach to stabilizing and/or controlling engine response curves. However, these sensors and associated controls are associated with costs and physical space requirements. There is a desire to reduce both the cost and size of marking engines. Therefore, there is a desire for systems and methods that maintain image quality, while eliminating the need for some or all of these sensors and associated control loops.

Some marking engine designs use feed-forward adjustment of process actuators based on lookup tables instead of run time density control. For example, temperature, relative humidity, print count, paper size and other parameters are used to generate and index into one or more lookup tables. The lookup tables provide setpoints for one or more xerographic actuators. Such systems also provide effective engine response curve stabilization. However, over time, due to system wear and other sources of drift, the setpoints stored in the tables can become outdated or inappropriate. Such systems would benefit from a simple and inexpensive means for recalibration, trimming or fine tuning.

Additionally, in order to provide increased production speed, document processing systems that include a plurality of marking engines have been developed. For example, the following co-pending applications, assigned, or under a duty to be assigned, to the same assignee as the present application, and which are hereby incorporated herein by reference for all they disclose, are related to aspects of multi-marking engine systems including but not limited to issues of sheet transportation and engine calibration and consistency using internal sensors: U.S. patent application Ser. No. 10/924,458 by Lofthus, et al. filed Aug. 23, 2004 and entitled PRINT SEQUENCE SCHEDULING FOR RELIABILITY; U.S. patent application Ser. No. 10/917,676 by Lofthus, et al. filed Aug. 13, 2004 and entitled MULTIPLE OBJECT SOURCES CONTROLLED AND/OR SELECTED BASED ON A COMMON SENSOR; U.S. patent application Ser. No. 10/761,522 by Mandel, et al. filed Jan. 21, 2004 and entitled HIGH PRINT RATE MERGING AND FINISHING SYSTEM FOR PARALLEL PRINTING; and U.S. patent application Ser. No. 10/917,768 by Lofthus filed Aug. 13, 2004 and entitled PARALLEL PRINTING ARCHITECTURE CONSISTING OF CONTAINERIZED IMAGE MARKING ENGINES AND MEDIA FEEDER MODULES.

In such systems, the importance of engine response control or stabilization is amplified. Subtle changes that would go unnoticed in the output of a single marking engine can be highlighted in the output of a multi-engine image rendering or marking system. For example, the facing pages of an opened booklet rendered or printed by a multi-engine printing system can be rendered by different devices. For instance, the left hand page in an open booklet may be rendered by a first print engine while the right-hand page is rendered by a second print engine. The first print engine may be rendering images in a manner just slightly darker than the ideal and well within a single engine tolerance. The second print engine may be rendering images in a manner just slightly lighter than the ideal and also within the single engine tolerance. While an observer might not ever notice the subtle variations when reviewing the output of either engine alone, when their output is compiled and displayed in the facing pages of a booklet the variation may become noticeable and be perceived by a printing services' customer as an issue of quality.

The following cited Patents are also hereby incorporated herein by reference for all they disclose.

U.S. Pat. No. 4,710,785, which issued Dec. 1, 1987 to Mills, entitled PROCESS CONTROL FOR ELECTROSTATIC MACHINE, discusses an electrostatic machine having at least one adjustable process control parameter. The machine receives and stores electrical image information of an original. A reproduction of the original is created using the received electrical image information signal, and a second electrical image information signal is in turn created from the reproduction. The second electrical image information signal is compared with the first electrical image information signal to produce an error signal representative of differences therebetween. The process control parameter is adjusted in response to the error signal to minimize said differences.

U.S. Pat. No. 5,510,896, which issued Apr. 23, 1996 to Wafler, entitled AUTOMATIC COPY QUALITY CORRECTION AND CALIBRATION, discloses a digital copier that includes an automatic copy quality correction and calibration method that corrects a first component of the copier using a known test original before attempting to correct other components that may be affected by the first component. Preferably, a scanner subsystem is first calibrated by scanning a known original and electronically comparing the scanned digital image with a stored digital image of the original. A hard copy of a known test image is then printed by a printer subsystem and the calibrated scanner subsystem scans the hard copy. The scanned digital image is electronically compared with the test image and the printer subsystem is calibrated based on the comparison.

U.S. Pat. No. 5,884,118, which issued Mar. 16, 1999 to Mestha, enitled PRINTER HAVING PRINT OUTPUT LINKED TO SCANNER INPUT FOR AUTOMATIC IMAGE ADJUSTMENT, discloses an imaging machine having operating components including an input scanner for providing images on copy sheets and a copy sheet path connected to the input scanner. The imaging machine is calibrated by providing an image on a first copy sheet and automatically conveying the first copy sheet to the input scanner by way of the copy path. The image on the first copy sheet is scanned and provides the image on a second copy sheet. The image on the second copy sheet is sensed and compared to a reference image to calibrate the imaging machine. The calibration sequence is automatically initiated via control data stored in memory.

U.S. Pat. No. 6,418,281, which issued Jul. 9, 2002 to Ohki, entitled IMAGE PROCESSING APPARATUS HAVING CALIBRATION FOR IMAGE EXPOSURE OUTPUT, discusses a method wherein a first calibration operation is preformed in which a predetermined grayscale pattern is formed on a recording paper and this pattern is read by a reading device to produce a LUT for controlling the laser output in accordance with the image signal (gamma correction). A second calibration operation is performed after the first calibration operation wherein a patch is formed on an image carrier by the laser output controlled by the above LUT, its density is detected by a detector and a correction LUT is generated in accordance with the detected density.

However, these Patents are not concerned with methods for improving or achieving image consistency between or among a plurality of marking engines.

For the foregoing reasons, there is a desire for methods and systems for calibrating, trimming, adjusting or fine tuning marking engine controls or setpoints, while eliminating or reducing the need for, or accuracy requirements of, at least some internal marking engine sensors.

BRIEF DESCRIPTION

A method operative to control image consistency in an image rendering system that includes an image input device, such as a scanner, operative to generate a computer readable representation of an imaged item, and a plurality of marking engines operative to render printed images, on print media, based on the computer readable representation includes, predetermining a test image, such as, for example, a mid-tone test patch, printing a first rendered version of the test image on print media with a first marking engine, generating a first computer readable representation of the first rendered version of the test image with the image input device, printing a second rendered version of the test image on print media with a second marking engine, generating a second computer readable representation of the second rendered version of the test image with the image input device, determining image consistency information from the first computer readable representation and the second computer readable representation, and if necessary, adjusting at least one aspect of the image rendering system in a manner predetermined to make an improvement in image consistency based on the determined image consistency information.

For example, some embodiments include a method operative to control image consistency in an image rendering or printing system that includes an image input device (e.g., a scanner or camera) operative to generate a computer readable representation of an imaged item, and a plurality of xerographic print engines operative to render printed images on print media based on the computer readable representation of the imaged item. The method includes predetermining a test image, printing a first rendered version of the test image on print media with a first xerographic print engine, generating a first computer readable representation of the first rendered version of the test image with the image input device, printing a second rendered version of the test image on print media with a second xerographic print engine, and generating a second computer readable representation of the second rendered version of the test image with the image input device. Of course, the order in which the printing and imaging or scanning takes place is not critical.

Additional aspects include determining image consistency information from the first computer readable representation and the second computer readable representation, and adjusting at least one xerographic actuator of at least one of the first and second xerographic print engines in a manner predetermined to make an improvement in image consistency based on the determined image consistency information.

In some embodiments, determining image consistency information can include determining a first lightness metric for at least a portion of the first computer readable representation, determining a second lightness metric for at least a portion of the second computer readable representation, comparing the first lightness metric to a target lightness associated with the predetermined test image, thereby determining a first difference between the first lightness metric and the target lightness, and comparing the second lightness metric to the target lightness, thereby determining a second difference between the second lightness metric and the target lightness.

Other aspects disclosed herein include comparing a magnitude of the first difference to a magnitude of the second difference, thereby determining a larger of the first difference and the second difference magnitude, if both of the first difference and the second difference have magnitudes less than a predetermined acceptable magnitude, and adjusting at least one xerographic actuator of the xerographic print engine associated with the larger of the first difference magnitude or the second difference magnitude.

Additionally, disclosed herein is adjusting at least one xerographic actuator of each of the first xerographic print engine and the second xerographic print engine if the magnitude of at least one of the first difference and the second difference is greater than the predetermined acceptable magnitude.

Adjusting at least one xerographic actuator can include, for example, adjusting at least one raster output scanner power and/or adjusting at least one scorotron grid voltage.

An image or document processing system, that can perform embodiments of the methods, can include an image input device operative to generate computer readable representations of imaged items, a plurality of xerographic print engines, each xerographic print engine having at least one xerographic actuator, a test patch generator operative to control each of the plurality of xerographic print engines to generate a printed version of a mid-tone test patch, a test patch analyzer operative to analyze computer readable versions of a plurality of test patches generated by the image input device, the plurality of test patches being associated with respective ones of the plurality of xerographic print engines, and operative to determine an amount at least one of the xerographic actuators should be adjusted based on the analysis, and a xerographic actuator adjuster operative to adjust the at least one xerographic actuator according to the amount determined by the test patch analyzer.

DETAILED DESCRIPTION

Figure 1:
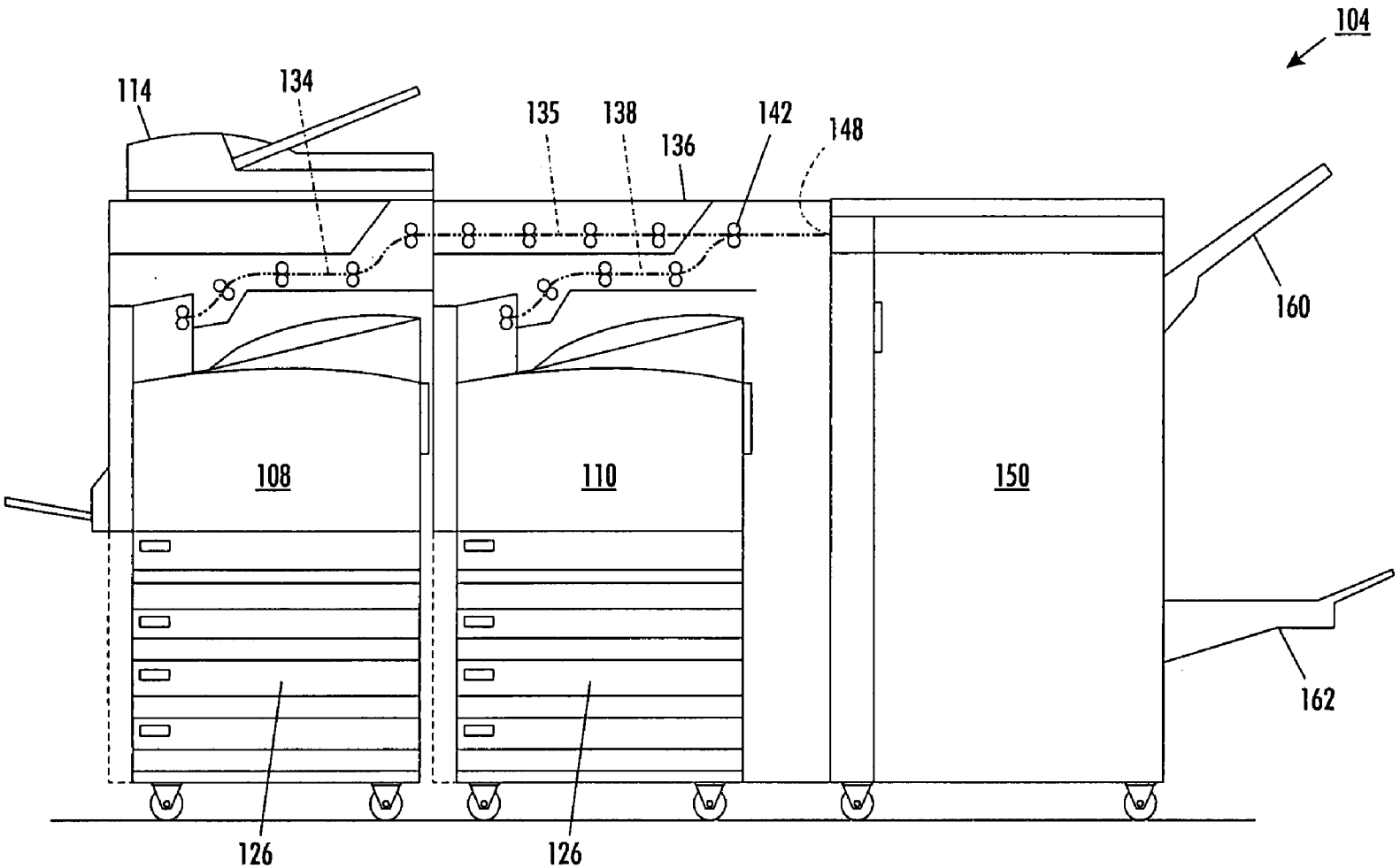
FIG. 1 is an elevation view of a first image or document processing system including a plurality of print engines.

Referring to FIG. 1, a first document processing system 104, that might incorporate embodiments of the methods and systems disclosed herein, includes a first image output terminal (IOT) 108, a second image output terminal 110 and an image input device 114, such as a scanner, imaging camera or other device. Each image output terminal 108, 110 includes a plurality of input media trays 126 and an integrated marking engine (e.g., see FIG. 2 and related description below). The first IOT 108 may support the image input device 114 and includes a first portion 134 of a first output path. A second portion 135 of the first output path is provided by a bypass module 136. The second IOT 110 includes a first portion 138 of a second output path. A third portion of the first path and a second portion of the second path begin at a final nip 142 of the second IOT 110 and include an input to a finisher 150.

The finisher 150 includes, for example, first 160 and second 162 main job output trays. Depending on a document processing job description and on the capabilities of the finisher 150, one or both of the main job output trays 160, 162 may collect loose pages or sheets, stapled or otherwise bound booklets, shrink wrapped assemblies or otherwise finished documents. The finisher 150 receives sheets or pages from one or both of the image output terminals 108, 110 via the input 148 and processes the pages according to a job description associated with the pages or sheets and according to the capabilities of the finisher 150.

A controller (not shown) orchestrates the production of printed or rendered pages, their transportation over the various path elements (e.g., 134, 135, 138, 142 and 148), and their collation and assembly as job output by the finisher 150. The produced, printed or rendered pages may include images transferred to the document processing system via a telephone communications network, a computer network, computer media, and/or images entered through the image input device 114. For example, rendered or printed pages or sheets may include images received via facsimile, transferred to the document processing system from a word processing, spreadsheet, presentation, photo editing or other image generating software, transferred to the document processor 104 over a computer network or on a computer media, such as, a CD ROM, memory card or floppy disc, or may include images generated by the image input device 114 of scanned or photographed pages or objects. Additionally, on an occasional, periodic, or as needed or requested basis, the controller (not shown) may orchestrate the generation, printing or rendering of test, diagnostic or calibration sheets or pages. As will be explained in greater detail below, such test, diagnostic or calibration sheets may be transferred, manually or automatically, to the image input device 114, which can be used to generate computer readable representations of the rendered test images. The computer readable representations may then be analyzed by the controller, or some auxiliary device, to determine image consistency information, and, if necessary, adjust some aspect of the image rendering system in a manner predetermined or known to make an improvement in, or achieve, image consistency. For example, electrophotographic, xerographic, or other rendering technology actuators may be adjusted. Alternatively, image path data may be manipulated to compensate or correct for some aspect of the rendering or marking process based on the analysis of the computer readable representations of the test images.

Figure 2:
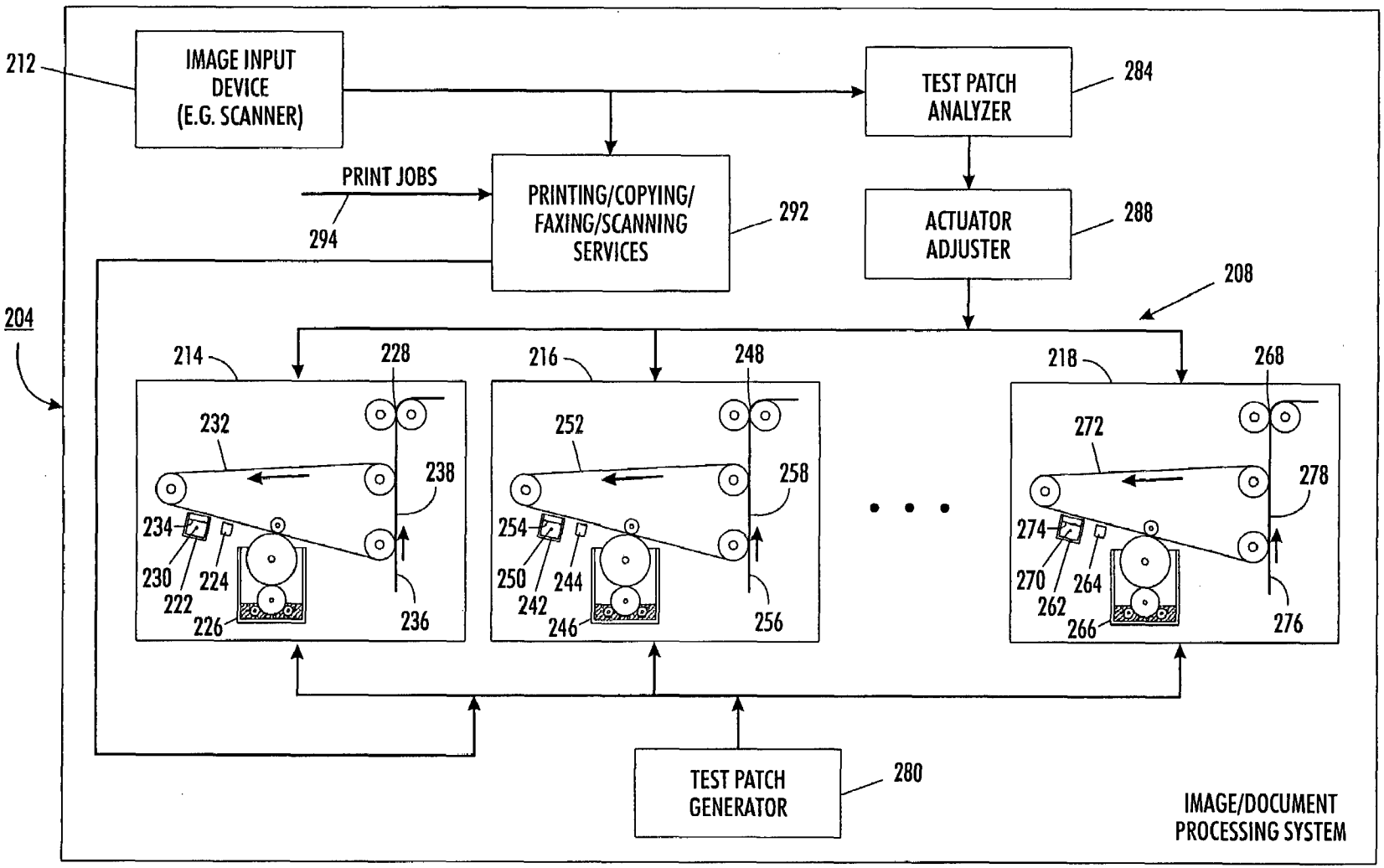
FIG. 2 is a block diagram of a second image or document processing system including a plurality of print engines including elements adapted to carry out the method of FIG. 3.

For instance, referring to FIG. 2, a second image or document processing system 204 includes a plurality 208 of print or marking engines and an image input device 212. For example, the plurality 208 of marking engines includes a first 214, second 216, and $n^{th}$ 218 xerographic marking engines. For simplicity, the xerographic marking engines 214, 216, 218 are illustrated as monochrome (e.g., black and white) marking engines. However, embodiments including color marking engines are also contemplated. Furthermore, embodiments including marking engines of other technologies are also contemplated.

Each marking technology is associated with marking technology actuators. For example, the first xerographic marking engine 218 includes a charging element 222, a writing element 224, a developer 226 and a fuser 228. Each of these can be associated with one or more xerographic actuators.

For instance, the charging element 222 may be a corotron, a scorotron, or a dicorotron. In each of these devices a voltage is applied to a coronode (wire or pins) 230. The voltage on the coronode 230 ionizes surrounding air molecules, which in turn cause a charge to be applied to a photoconductive belt 232 or drum. Where the charging element 222 is a scorotron, the scorotron includes a grid 234. A grid voltage is applied to the grid 234. The scorotron grid is located between the coronode 230 and the photoconductor 232 and helps control the charge strength and the charge uniformity of the charge applied to the photoconductor 232. The coronode voltage and the grid voltage are xerographic actuators. Changing either voltage may result in a change in the charge applied to the photoconductor 232, which in turn may affect an amount of toner attracted to the photoconductor 232 and therefore the lightness or darkness of a printed or rendered image. Many xerographic marking engines include one or more electrostatic volt meters (ESV) for measuring the charge applied to the photoconductor 232. A control loop receives information from the ESV and adjusts one or both of the coronode voltage and the grid voltage in order to maintain a desired ESV measurement. However, the methods and systems disclosed herein reduce or eliminate the need for these ESV based control loops, and the marking engines 214, 216, and 218 of the second image or document processor 204 do not include electrostatic volt meters.

The writing element 224 is for example, a raster output scanner (ROS). For instance a raster output scanner includes a laser, and a polygonal arrangement of mirrors, which is driven by a motor to rotate. A beam of light from the laser is aimed at the mirrors. As the arrangement of mirrors rotates a reflected beam scans across a surface of the photoconductor 232. The beam is modulated on and off. As a result, portions of the photoconductor 232 are discharged. Alternatively, the ROS includes one or more light emitting diodes (LEDs). For instance, an array of LEDs may be positioned over respective portions of the photoconductor 232. Lighting an LED tends to discharge the photoconductor at positions associated with the lit LED. ROS exposure is a xerographic actuator. For example, the exposure, or amount of light that reaches the photoconductor 232, is a function of ROS power and/or ROS exposure time. The higher the laser or LED power, the more discharged associated portions of the photoconductor 232 become. Alternatively, the longer a particular portion of the photoconductor 232 is exposed to laser or LED light, the more discharged the portion becomes. The degree to which portions of the photoconductor 232 are charged or discharged affects the amount of toner that is attracted to the photoconductor 232. Therefore, adjusting ROS exposure adjusts the lightness of a rendered or printed image.

The developer 226 includes a reservoir of toner. The concentration of toner in the reservoir has an effect on the amount of toner attracted to charge portions of the photoconductor 232. For instance, the higher the concentration of toner in the reservoir, the more toner is attracted to portions of the photoconductor 232. Therefore, toner concentration in the reservoir is a xerographic actuator. Toner concentration can be controlled by controlling the rate at which toner from a toner supply is delivered to the developer toner reservoir.

Many xerographic marking engines include an optical density sensor for measuring the density of toner applied to the photoconductor 232. For example, test patches are developed on interdocument zones on the photoconductor 232. The optical density sensor measures the density of toner applied in the test patches and xerographic actuators are adjusted if the optical density sensors report that the toner density in the test patch is different from a target density. However, the systems and methods disclosed herein reduce or eliminate the need for optical density sensor measurements, and the marking engines 214, 216, 218 of the second image or document processing system 204 do not include optical density sensors.

Print media, such as sheets of paper or velum, is transported on a media transport 236. Toner on the photoconductor 232 is transferred to the media at a transfer point 238. The print media is transported to the fuser 228 where elevated temperatures and pressures operate to fuse the toner to the print media. Pressures and temperatures of the fuser 228 are xerographic actuators.

Other xerographic actuators are known. Additionally, other printing technologies include actuators that can be adjusted to control the lightness or darkness of a printed or rendered image. For example, in ink jet based marking engines a drop ejection voltage controls an amount of ink propelled toward print media with each writing pulse. Therefore, drop ejection voltage is an ink jet actuator.

The second xerographic marking engine 216 also includes a charging element 242, a writing element 244, a developer 246, a fuser 248, a coronode 250 and a photoconductor 252. The charging element may include a charging grid 254. A media transport 256 carries print media to a transfer point 258 and to the fuser 248.

Other xerographic print engines in the second document or imaging processing system 204 include similar elements. For instance, the $n^{th}$ xerographic print engine 218 includes a charging element 262, a writing element 264, a developer 266 and a fuser 268. The charging element 262 may include a coronode 270 for ionizing molecules to charge a photoconductor 272. If the charging element 262 is, for example, a scorotron, the charging element 262 may include a grid 274. The $n^{th}$ xerographic marking engine 218 may also include, or be associated with a media transport 276, for carrying print media to a transfer point 278, to the fuser 268 and beyond (i.e., to a finisher or output tray).

The second document or image processing system 204 also includes a test patch generator 280, a test patch analyzer 284 and an actuator adjuster 288. The system 204 may also include one or more of printing, copying, faxing and scanning services 292. For example, the test patch generator 280, test patch analyzer 284 and actuator adjuster 288 are embodied in software run by a controller (not shown). Alternatively, one or more of the test patch generator 280, test patch analyzer 284, and actuator adjuster 288 are implemented in hardware, which is supervised by the controller (not shown).

The test patch generator 280, test patch analyzer 284, actuator adjuster 288, image input device 212 and two or more of the plurality 208 of print or marking engines, cooperate to perform one or more methods that are operative to control image consistency.

For instance, the test patch generator 280 is operative to control each of the plurality of xerographic print engines to generate a printed version of a midtone test patch. The printed version of the midtone test patch from each of the plurality of print engines is delivered, manually or automatically, to the image input device 212 which operates to generate a computer readable representation of the printed midtone test patches. The test patch analyzer 284 is operative to analyze computer readable versions of the plurality of test patches, generated by the image input device 212. Additionally, the test patch analyzer is operative to determine an amount at least one xerographic actuator should be adjusted based on the analysis. The actuator adjuster 288 is operative to adjust the at least one xerographic actuator according to the amount determined by the test patch analyzer 284. The test patch generator 280, test patch analyzer 284, and actuator adjuster 288 are included as a means for controlling or adjusting image quality in main print job production.

For instance, a main function of the image input device 212 is for generating computer readable representations or versions of imaged items, such as, a printed sheet or a collection of printed sheets, so that copies of the imaged item or items can be printed or rendered by one or more of the plurality 208 of marking engines. In addition to these copying services (292), the document or image processing system 204 may provide printing, faxing and/or scanning services (292). For example, print job descriptions 294 may be received by the image or document processing system 204 over a computer network or on computer readable media. Additionally, print jobs 294 may include incoming or received facsimile transmissions. The printing, copying, faxing, scanning services 292 of the image or document processing system 204 control one or more of the first 214, second 216, and/or $n^{th}$ 218 printing or marking engines to produce the received print jobs 294.

As will be described in greater detail below, the image input device 212, test patch generator 280, test patch analyzer 284 and actuator adjuster 288 operate to control or adjust the plurality 208 of marking engines so that portions of such print jobs printed on a first (e.g., 214) marking engine appear the same as portions printed or rendered using a second (e.g., 216 or 218) print engine.

Figure 3:
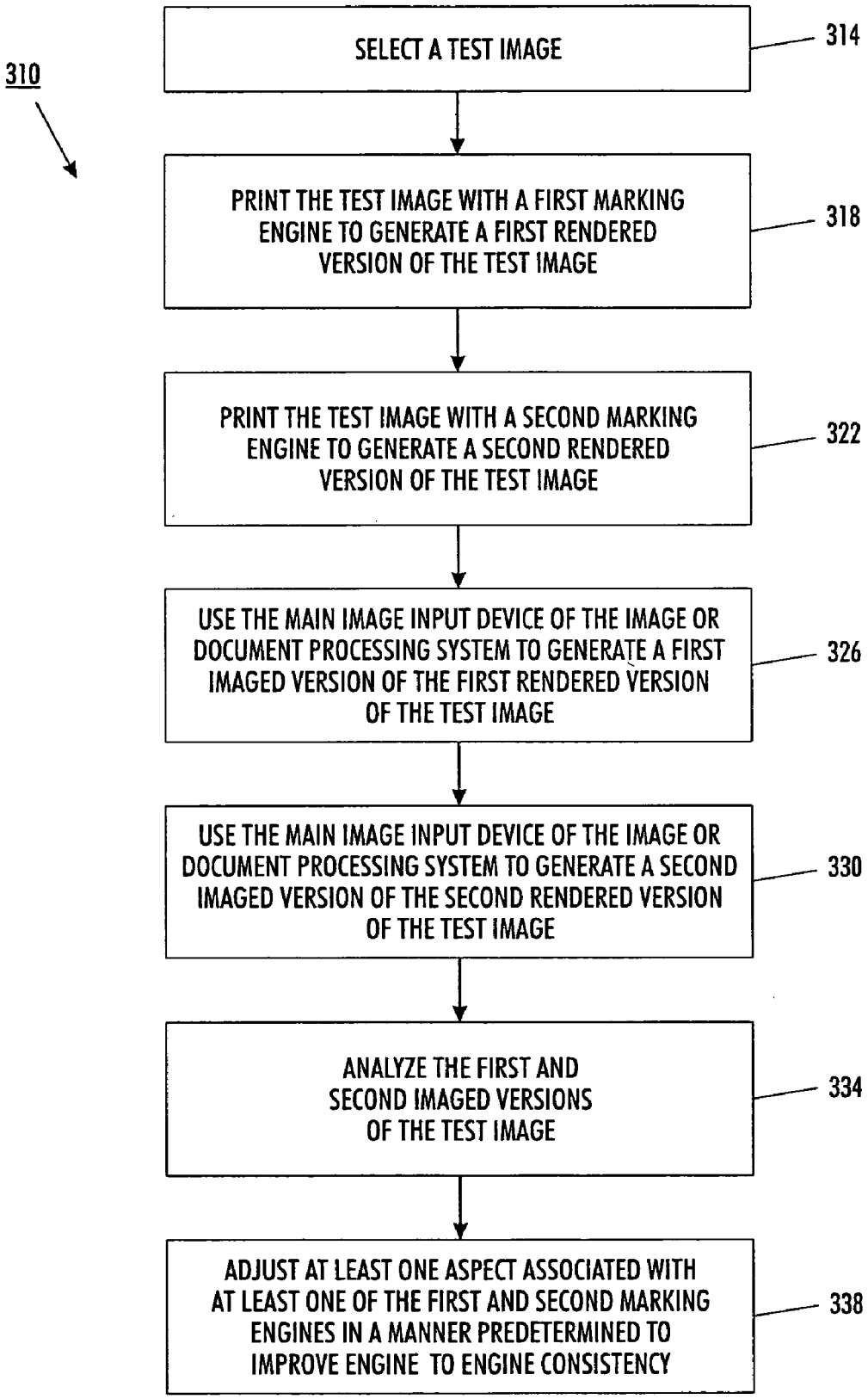
FIG. 3 is a flow chart outlining a method for using a main image input device of an image or document processing system to image test image prints from a plurality of marking engines, and to control image consistency of the marking engines based on the imaged test prints.

For example, referring to FIG. 3, a method 310 operative to control image consistency in an image rendering system that includes an image input device (e.g., 114, 212) and a plurality of marking engines (e.g., 108, 110, 214, 216, 218) includes selecting 314 a test image, printing 318 the test image with a first marking engine (e.g., 108, 214) to generate a first rendered version of the test image, printing 322 the test image with a second marking engine (e.g., 110, 216 or 218) to generate a second rendered version of the test image, using 326 a main image input device (e.g., 114, 212) of the image or document processing system (e.g., 104, 204) to generate a first imaged version of the first rendered version of the test image, using 330 the main image input device (e.g., 114, 212) of the document processing system (e.g., 104, 204) to generate a second imaged version of the second rendered version of the test image, analyzing 334 the first and second imaged versions of the test image and adjusting 338 at least one aspect associated with at least one of the first and second marking engines in a manner predetermined to improve engine to engine consistency.

The phrase—main image input devices—is meant to refer, in embodiments disclosed herein, to, for example, image input devices (e.g.114, 212) such as, a scanners or cameras and the like, associated with image or document processors, which are used mainly for generating computer readable versions of images for manipulation and/or printing, and not to imply that such input devices are the sole or most important source of images to be printed by the image or document processors.

Selecting 314 a test image may include selecting a test image appropriate for the aspect of printing or marking to be analyzed and controlled or compensated for. For example, Monte Carlo simulations of 1000 marking engines of a particular type, with randomized developer and xerographic replaceable unit (XRU) (including the photoconductor, charging element and a cleaning blade) age, indicate that variation in marking engine response curves (over time and from marking engine to marking engine), related to the overall lightness or darkness of rendered images, can be controlled or compensated for by analyzing 334 midtone test patches rendered or printed 318, 322 by the marking engines and scanned or otherwise imaged 326, 330 using a main image input device (e.g., 114, 212). Midtone test patches include test patches intended to have a halftone unit cell area coverage of about 30% to about 70%. Test patch selection 314 may be based on a desire to study, analyze, correct or compensate for a particular portion of the engine response curve of one or more engines. However, the simulations indicate that good engine response stabilization can be achieved by periodically rendering 318, 322, scanning 326, 333, analyzing 334 and adjusting 338, based on the analysis of a single test patch (for each engine) intended to have an area coverage of about 50%.

Test image selection 314 may occur during system design or manufacture. For instance, a single test image or a set of selectable test images may be represented in digital form and stored in a system memory. Additionally, or alternatively, a system user may periodically, or on an as needed or desired basis, select a particular compensation or adjustment mode, and thereby select an appropriate test image from a plurality of test images stored in the system. Additionally, test images may be provided in the form of standard test image prints, which are scanned or otherwise imaged and represented in computer readable form through the use of a main image input device (e.g., 114, 212).

Printing or rendering 318, 322 the selected test image proceeds as would the printing or rendering of images from any other print job. For example, printing the first test image includes using the charging element 222 to place a charge on the photoconductor 232. The photoconductor 232 moves. The writing element 224 is used to expose selected portions of the photoconductor 232 to light. The exposed portions are discharged according to the level of exposure. The portions selected to be exposed are based on the selected 314 test image. The charged and uncharged portions are transported to the developer 226. Depending on the system and toner type, toner is attracted to charged or discharged portions of the photoconductor 232. The photoconductor 232 continues to move and the developed image is brought to the transfer point 238 and brought into contact with print media, such as a sheet of paper or velum, while and electrostatic field is applied. The print media is then transported to the fuser 228 where the toner is fused to the print media. The printed sheet is then transported to an output tray (e.g., 160, 162).

Printing 322 or generating the second rendered version of the test image proceeds in a similar manner but on a second or different marking engine, such as, for example, the second 216 marking engine or any other of the plurality 208 of marking engines, including, for example, the $n^{th}$ 218 marking engine. Of course, printing 322 the second test image with the second 216 marking engine would involve using the charging element 242, the writing element, the developer 246, the photoconductor 255, the transfer point 258 and the fuser 248 of the second 216 marking engine. Using the $n^{th}$ 218 marking engine to print 322 or generate the second rendered version of the test image would involve using the charging element 262, writing element 264, developer 266, photoconductor 272, transfer point 278 and fuser 268 of the $n^{th}$ marking engine.

Where marking engines of the plurality 208 include other marking technologies, other elements actuators are involved. For example, where the plurality 208 includes marking engines that are based on ink jet technology, marks are placed on media with an ink jet printhead involving piezoelectric or thermal ink ejection technologies.

Independent of which marking engine, or which marking technology is used to generate it, the second rendered 322 version of the test image is transported to an output tray (e.g., 160, 162).

From the output tray or trays (e.g., 160, 162) the rendered 318 322 versions of the test image are transported, either manually by, for example, a system operator or user, or by some automatic transport mechanism, to a main image input device (e.g., 114, 212). For example, the first rendered 318 version and the second rendered 322 version of the test image may be placed one at a time on a platen of a system scanner, camera or other imaging device. Alternatively, the first rendered 318 version and the second rendered 322 version of the test image may be delivered to a document feeder associated with a scanner or other imaging device. In either case, the main image input device (e.g.,114, 212) generates 326 a first imaged or computer readable version of the first rendered version of the test image and generates 330 a second imaged or computer readable version of the second rendered version of the test image. For example, a light source illuminates the rendered (322, 326) versions of the test image. A one dimensional array of photosensors, such as, photodiodes or phototransistors measures an amount of light reflected from respective portions of the rendered versions of the test image. For instance, the array of light sensors is moved or scanned, over or past, the rendered versions of the test image. Alternatively, a two dimensional array of photosensors is used, and a system of one or more lenses focuses an image of the rendered versions of the test image on the array. In either case, a computer readable version of the first rendered version and a computer readable version of the second rendered version of the test image are generated. For example, contone or gray level values associated with the reflected light measurements of the photosensors are recorded in association with position information. Additionally, or alternatively, the contoned or gray level values may be compared to a threshold and representative binary values may be recorded in association with the position information indicating whether the position is "light" or "dark". For instance, the photosensor measurement information is provided to a test patch analyzer (e.g., 284). If necessary, the test patch analyzer stores the data as described above and begins the analysis process.

Analyzing 334 the first and second imaged versions of the test image can include any analysis appropriate to the test image and the aspect or aspects of marking engine processes that are being studied, analyzed, adjusted or compensated for. In the Monte Carlo simulations mentioned above, the aspect of the test images that was used to determine xerographic actuator adjustment 338, was lightness. Specifically, relative L*, as defined by the Commission Internationale de I'Eclairages (CIE) was analyzed and compensated for. Relative L* is calculated by comparing a background lightness to the lightness of an image or test patch. For example, contone values or gray levels are determined for a white or unmarked portion of the imaged version of a test image. For example, the test image is a midtone test patch having an area A. During the imaging or scanning processes (e.g., 326, 330) the test patch is imaged, as is an adjacent unmarked portion of the rendered 318, 322 image sheet. Contone or gray level values are measured and recorded for both the test patch and the adjacent unmarked portions. An unmarked portion of the test image also having an area A is selected. Contone or gray scale values associated with pixels or measurements of that area are averaged. Contone or gray level values of the test patch area are also averaged. A ratio of the two averages R=average patch contone value/average unmarked (paper or media) contone value is determined. Based on that ratio (R) relative L* is calculated according to the equation $L^*=116\times R^{1/3}-16$.

The analysis 334 continues with a comparison of the determined parameters or parameters associated with the test images (or imaged test images), to some standard or target parameter value or values, and/or with a comparison of the calculated or determined parameters associated with the first test image and the second test image to each other. The results of such comparisons may then be used to calculate or determine an adjustment amount for at least one aspect of marking engine operation, such as, for example, a xerographic actuator, ink jet ejection voltage or power, or to an image path compensation means.

In the Monte Carlo simulations mentioned above, raster output scanner (ROS) exposure and charging scorotron grid voltage were determined to be effective actuators for controlling or reducing engine response curve variation. However, other actuators or compensation means may be used.

Figure 4:
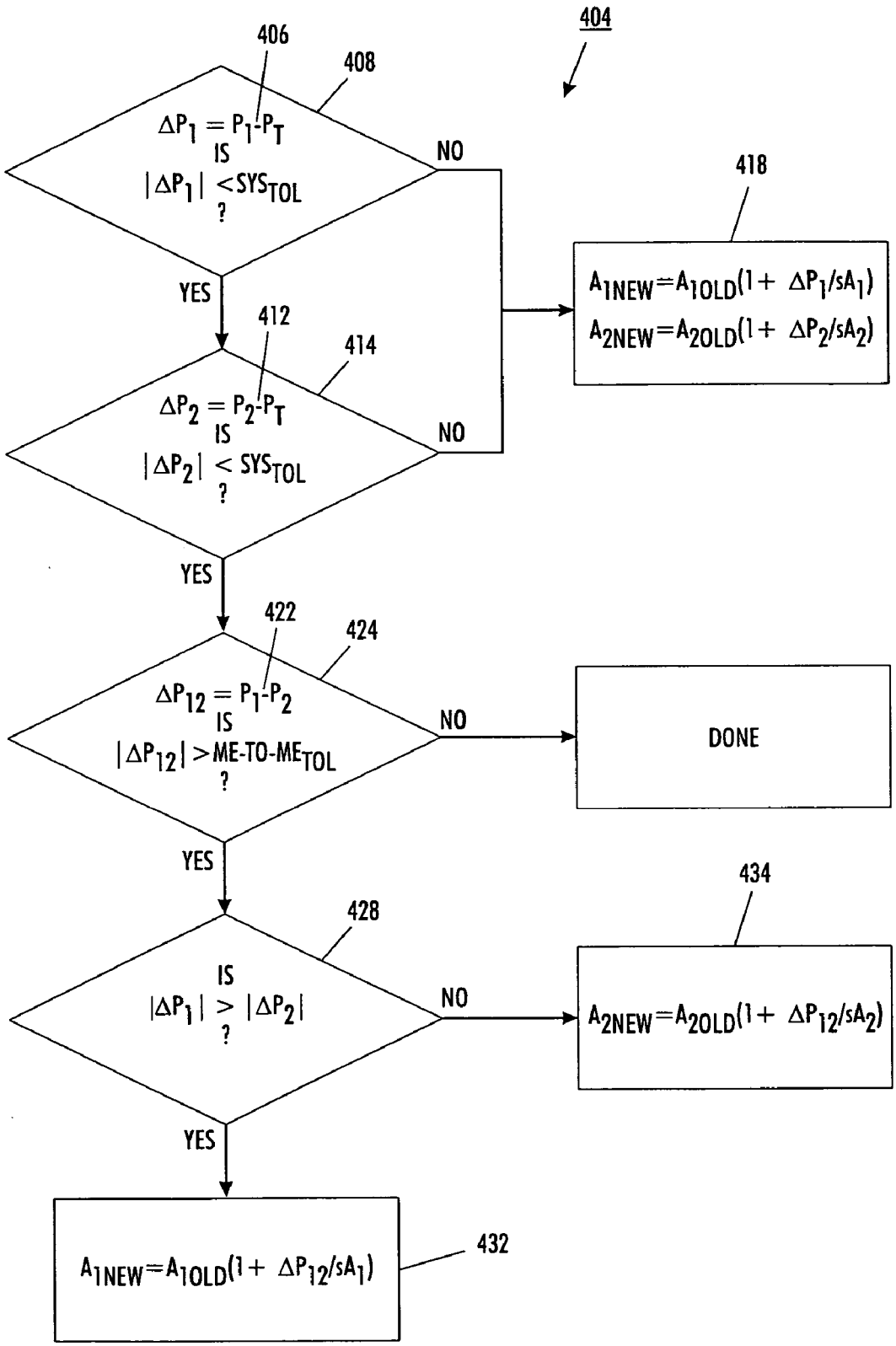
FIG. 4 is a flow chart outlining a method for analyzing imaged test prints and determining new settings based on the analysis.

Referring to FIG. 4, one general 404 form of analysis 334 includes comparing 406 a first aspect or parameter ($P_1$) of the first computer readable or imaged 326 version of the first rendered version of the test image to a predetermined aspect or parameter target value ($P_T$), thereby determining a first difference ($\Delta P_1$) between the first aspect or parameter ($P_1$) of the first computer readable representation of the test image and the target value ($P_T$) for that aspect or parameter (P). The magnitude of the first difference ($\Delta P_1$) is compared 408 to a system tolerance ($SYS_{TOL}$) for that parameter or aspect.

Similar processing is carried out with regard to the second computer readable or imaged 330 version of the second rendered version of the test image. A second aspect or parameter ($P_2$) of the second computer readable representation or imaged 330 version of the second rendered version of the test image is compared 412 to the aspect or parameter target ($P_T$), thereby determining a second difference ($AP_2$) between the second aspect or parameter ($P_2$) of the second computer readable representation to the target aspect or parameter ($P_T$). The magnitude of the second difference ($\Delta P_2$) is also compared 414 to the system tolerance.

If either the magnitude of the first difference ($\Delta P_1$) or the magnitude of the second difference ($\Delta P_2$) is greater than the system tolerance threshold ($SYS_{TOL}$), then an adjustment amount is determined 418 based on the first difference ($\Delta P_1$) and the second difference ($\Delta P_2$) respectively. For instance, a new actuator setting (or image path compensation parameter) ($A_{1\ NEW}$) for the first printing or marking engine may be a function of the current actuator setting ($A_{1\ OLD}$), the first difference ($\Delta P_1$) and a predetermined sensitivity ($sA_1$) of the first aspect or parameter ($P_1$) to changes in the actuator setting. Likewise, a new actuator (or image path compensation parameter) setting ($A_{2\ NEW}$) for the second printing or marking engine may be determined 418 as a function of the current actuator setting ($A_{2\ OLD}$), the second difference ($\Delta P_2$) and a predetermined sensitivity ($sA_2$) of the second aspect or parameter ($P_2$) to changes in the second actuator setting.

In the embodiment illustrated in FIG. 4, the functions are selected so that the determined 418 new actuator settings ($A_{1\ NEW}$), ($A_{2\ NEW}$) tend to drive the first parameter ($P_1$) of the first marking engine and the second parameter ($P_2$) of the second marking engine toward the target parameter ($P_T$) and therefore, toward each other. Additionally, if either the first difference ($\Delta P_1$) or the second difference ($\Delta P_2$) is determined 406, 412 to be zero, the functions of the illustrated embodiment provide for determining 418 new actuator settings to be the same as the current actuator settings. Since, the new actuator settings tend to drive the aspects or parameters ($P_1$), ($P_2$)of the first and second marking engines (e.g., 108, 110 or 214, 216 or 218) toward the target parameter ($P_T$) and therefore, toward each other, they improve, or achieve, image consistency from print to print within each engine individually, and between prints rendered or printed with different marking engines (e.g., 108, 110 or 214, 216 or 218).

It may also be desirable to drive the first parameter ($P_1$) of the first print engine and the second parameter ($P_2$) of the second print engine toward one another even when both aspects or parameters ($P_1$), ($P_2$) are within the system tolerance (e.g., $SYS_{TOL}$) of the target parameter value ($P_T$). Therefore, if the determination 408 is made that the magnitude of the first difference is less than the system tolerance threshold for the target parameter ($P_T$), and the determination 414 is made that the magnitude of the second difference ($\Delta P_2$) is less than the system tolerance threshold for the target parameter value ($P_T$), then the first aspect or parameter value ($P_1$) can be compared 422 to the second aspect or parameter value ($P_2$), thereby determining a first marking engine to second marking engine variation or difference ($\Delta P_{12}$). At that point, a determination 424 can be made as to whether the magnitude of the marking engine to marking engine difference ($\Delta P_{12}$) is greater than a marking engine to marking engine tolerance threshold (ME-to-$ME_{TOL}$).

If it is determined 424 that the marking engine to marking engine variation or difference ($\Delta P_{12}$) is greater than the marking engine to marking engine tolerance(ME-to-$ME_{TOL}$), a determination 428 is made as to which of the magnitude of the first difference ($\Delta P_1$) and the magnitude of the second difference ($\Delta P_2$) is larger. If the magnitude of the first difference ($\Delta P_1$) is larger, then a determination 432 of a new actuator setting ($A_{1\ NEW}$) for the first marking engine (e.g., 108, 214) may be made from a function of the current actuator setting ($A_{1\ OLD}$), the marking engine to marking engine variation or difference ($\Delta P_{12}$) and the predetermined sensitivity ($sA_1$) of the first parameter ($P_1$) to changes in the first actuator setting ($A_1$). Likewise, if it is determined 428 that the magnitude of the second difference ($\Delta P_2$) is larger than the magnitude of the first difference ($\Delta P_1$), then a new second actuator setting ($A_{2\ NEW}$) may be determined 434 from a function of the current second actuator setting ($A_{2\ OLD}$), the marking engine to marking engine variation or difference ($\Delta P_{12}$) and the sensitivity ($sA_2$) of the second parameter or aspect ($P_2$) to changes in the second actuator setting.

In the illustrated embodiment of FIG. 4, the selected functions for determining 432, 434 new values for the first actuator setting ($A_1$) and the second actuator setting ($A_2$) tend to drive the aspect of the affected marking engine toward the same value as the similar aspect of the other marking engine.

As indicated above, in the Monte Carlo simulations, the aspect or parameter (P) that was measured and controlled was L*. The actuator (A) that was adjusted 338 was ROS exposure. However, it is anticipated that charging scorotron grid voltage can also be used to control or adjust marking engine L*. Furthermore, other aspects or parameters of rendering device performance may also be controlled or compensated for according to the methods outlined in FIG. 3 and FIG. 4.

For example, test images might be selected for measuring gloss, registration and Euclidean color distance (e.g., ΔE). Such targets may be printed (e.g., 318, 322), and a main image input device (e.g., 114, 212) may be used (e.g., 326, 330) to scan or otherwise generate imaged or computer readable versions of the printed or rendered 318, 322 versions of the test image. Test patch analyzers 284 might be used to analyze 334 the computer readable versions of the test image and determine new settings for actuators or image path adjustments for use by an actuator adjuster 288. For instance, gloss may be controlled by adjusting fuser (e.g., 228, 248, 268) temperature, registration may be controlled by adjusting 338 ROS alignment or timing, or by applying compensating warpings in the image path. Color (e.g., ΔE) may be corrected or controlled by adjusting exposure or ROS power levels. Alternatively, the shape and position of compensating tone reproduction curves (TRCs), which operate on image data, may be adjusted 338. Furthermore, more than one actuator or image path compensation may be used to correct a particular aspect or parameter of marking engine operation.

Figure 5:
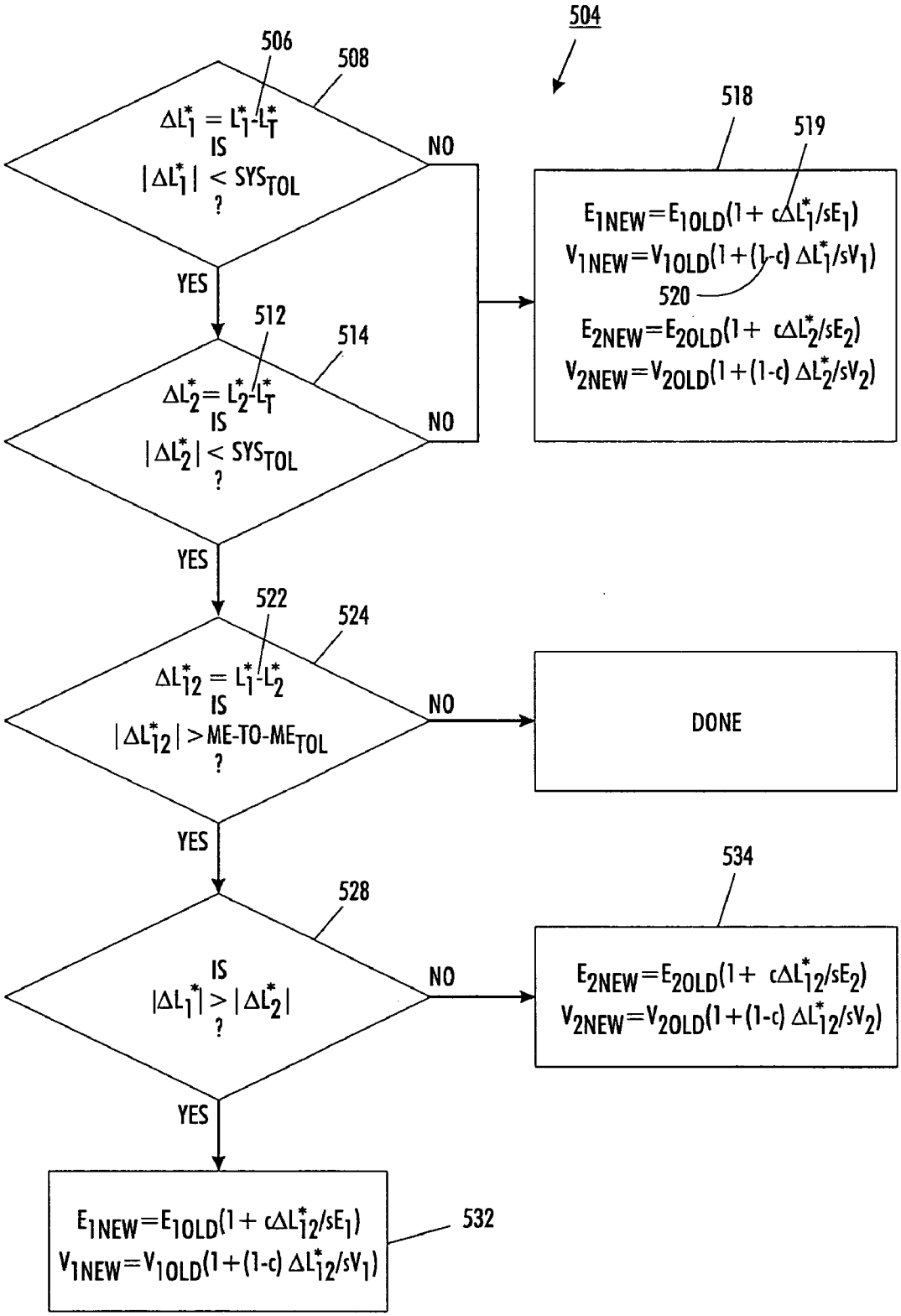
FIG. 5 is a flow chart outlining another method for analyzing imaged test prints and determining new settings based on the analysis.

For example, referring to FIG. 5, a second method 504 of analysis 338 is similar to the first method 404. However, in the second method 504, a specific parameter (P) has been selected for analysis and control. The aspect or parameter of marking engine performance selected is lightness (L*). Therefore, a first lightness ($L_1$*) is calculated based on a scanned, imaged or generated 326 computer readable version of a first printed or rendered 318 version of a selected 314 test image printed with a first marking engine and compared 506 with a target lightness ($L_T$*), thereby determining a first lightness difference ($\Delta L_1$*). The magnitude of the first lightness difference ($\Delta L_1$*) is compared 508 to a system tolerance threshold. Similarly, a second lightness ($L_2$*) is calculated from a second scanned, generated or imaged 330 computer readable version of a second rendered 322 version of the test image printed with a second marking engine. The second lightness ($L_2$*) is compared 512 to the target lightness ($L_T$*), thereby generating, calculating or determining, a second difference ($\Delta L_2$*). If the magnitude of either the first difference ($\Delta L_1$*) or the second difference ($\Delta L_2$*) is greater than the system tolerance threshold, new actuator settings are determined 518 for actuators associated with both the first and second marking engines (e.g., 108, 110, 214, 216 or 218).

However, in contrast to the determination 418 made in the first 404 method of analysis, the determination 518 of the second method 504 of analysis 334 includes determining new settings for more than one actuator for each marking engine. For example, new settings are determined 518 for a ROS exposure actuator (E) and for a scorotron grid voltage (V) for each marking engine. For example, the new exposure for the first marking engine ($E_{1\ NEW}$) is a function of the current exposure setting for the first marking engine ($E_{1\ OLD}$), the first lightness difference ($\Delta L_1$*), a predetermined sensitivity ($sE_1$) of the lightness ($L_1$*) of the first marking engine to changes in exposure ($E_1$), and an apportioning constant c.

The apportioning constant c is applied to a term 519 including the first difference ($\Delta L_1$*) and the sensitivity ($sE_1$) of the first lightness ($L_1$*) to changes in ROS exposure ($E_1$).

The new grid voltage ($V_{1\ NEW}$) of a first scorotron of the first marking engine is determined 518 based on a function of the current first scorotron grid voltage ($V_{1\ OLD}$), the first lightness difference ($\Delta L_1$*) and a sensitivity ($sV_1$) of the first lightness ($L_1$*) to changes in the first grid voltage ($V_1$) and an apportioning factor 520 having a value of one minus the apportioning constant (c) (i.e.; 1-c). The apportioning factor 520 is applied to a term 521 including the first lightness difference ($\Delta L_1$*) and the sensitivity ($sV_1$) of the first lightness ($L_1$) to changes in the first scorotron grid voltage ($V_1$). The apportioning constant may be restricted to a value between 0 and 1 inclusive. When the apportioning constant (c) has a value of 1, the apportioning factor 520 has a value of 0 and the new grid voltage ($V_{1\ NEW}$) for the first scorotron is equal to the current grid voltage ($V_{1\ OLD}$) and only the ROS exposure ($E_1$) is used to control the lightness ($L_1$*) in the first marking engine. When the apportioning constant (c) has a value of 0, the converse is true. The new ROS exposure setting ($E_{1\ NEW}$) is set equal to the current ROS exposure ($E_{1\ OLD}$) and only the first scorotron grid voltage (($V_1$) is used to control or adjust lightness ($L^*_1$) in the first marking engine. When the apportioning constant (c) has an intermediate value, both the ROS exposure ($E_1$) and the scorotron grid voltage ($V_1$) are updated to contribute to the control of lightness ($L^*_1$) in the first marking engine.

As can be seen in FIG. 5, new settings for ROS exposure and scorotron grid voltage in the second marking engine are determined 518 from functions having a similar form to the functions discussed above with reference to the first marking engine. However, the functions are based on the second lightness difference ($\Delta L_2$*), sensitivities ($sE_2$, $sV_2$) of the second lightness ($L_2$) of the second marking engine to changes in ROS exposure ($E_2$) and scorotron grid voltage ($V_2$) and current ROS exposure ($E_{2\ OLD}$) and scorotron grid voltage ($V_{2\ OLD}$) in the second marking engine, instead of the similar parameters relating to the first marking engine.

As was the case in reference to FIG. 4, the determinations 518 tend to drive the lightness parameters of the first and second marking engines toward the lightness target value ($L^*_T$), and thereby within the system tolerance ($SYS_{TOL}$) and toward each other. This has the effect of improving image consistency over time within a single marking engine and between marking engines.

However, it may also be desirable to drive the lightness parameters of marking engines in an image or document processing system toward one another even when the marking engines are all operating within a system tolerance (e.g., $SYS_{TOL}$).

Therefore, when both the first lightness difference ($\Delta L_1$*) and the second lightness difference ($\Delta L_2$*) have magnitudes that are less than the system lightness tolerance ($SYS_{TOL}$) the first lightness ($L_1$*) is compared to the second lightness ($L_2$*), thereby determining a third lightness difference ($\Delta L_{12}$*) between the first marking engine and the second marking engine.

If the third lightness difference ($\Delta L_{12}$*) between the marking engines is greater than a marking engine to marking engine lightness tolerance (ME-to-$ME_{TOL}$) then the magnitude of the first lightness difference ($\Delta L_{1'}$*) is compared to the magnitude of the second lightness difference ($\Delta L_2$*) and new actuator settings are determined for the marking engine associated with the largest difference magnitude (532 or 534). The functions by which the new settings are determined are similar in form to the functions described in reference to the determination 518 associated with at least one of one of the first and second differences ($\Delta L_1$* or $\Delta L_2$*) being greater than the system lightness tolerance. However, instead of being based on the respective lightness differences ($\Delta L_1$* or $\Delta L_2$*) the determinations 532, 534 are made based on the third lightness difference ($\Delta L_{12}$*) between the first and second marking engines. The new determined (532 or 534) marking engine actuator settings will drive the lightness of the affected marking engine toward the lightness of the other marking engine. Therefore, the second method 504 of analyzing 333 the scanned, generated or imaged (326, 330) versions of the printed or rendered (318, 322) test image is operative to control or maintain marking engine to marking engine consistency.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications, variations, improvements, and substantial equivalents.

The invention claimed is:

1. A method operative to control image consistency in an image rendering system that includes an image input device operative to generate a computer readable representation of an imaged item and a plurality of marking engines operative to render printed images on print media based on the computer readable representation, the method comprising:

predetermining a test image;

printing a first rendered version of the test image on print media with a first marking engine of the plurality of marking engines;

generating a first computer readable representation of the first rendered version of the test image with the image input device;

printing a second rendered version of the test image on print media with a second marking engine of the plurality of marking engines;

generating a second computer readable representation of the second rendered version of the test image with the image input device;

determining image consistency information from the first computer readable representation and the second computer readable representation; and if necessary, adjusting at least one aspect of the image rendering system, in a manner predetermined to improve image consistency, based on the determined image consistency information.

2. The method of claim 1 wherein generating the first and second computer readable representations comprises:

scanning the first and second rendered versions.

3. The method of claim 1 wherein determining image consistency information comprises:

comparing an aspect of the first and second computer readable representations to a predetermined aspect target, thereby determining a difference between the aspect of the first computer readable representation and the aspect of the second computer readable representation to the aspect of the target.

4. The method of claim 3 further comprising:

comparing the difference between the aspect of the first computer readable representation and the target to the difference between the aspect of the second computer readable representation and the target.

5. The method of claim 1 wherein determining image consistency information comprises:

comparing an aspect of the first computer readable representation and a similar aspect of the second computer readable representations to each other, thereby determining a difference between the aspect of the first computer readable representation and the aspect of the second computer readable representation.

6. The method of claim 1 wherein determining image consistency information comprises:

determining image lightness information from the first and second computer readable representations by determining a ratio of gray scale values associated with a marked portion of the test image and gray scale values associated with an unmarked portion of the test image for each of the first and second computer readable representations.

7. The method of claim 1 wherein adjusting at least one aspect of the image rendering system comprises:

adjusting a marking engine actuator of at least one of the first marking engine and the second marking engine.

8. The method of claim 7 wherein adjusting the marking engine actuator comprises:

adjusting a raster output scanner exposure set point.

9. The method of claim 7 wherein adjusting the marking engine actuator comprises:

adjusting a scorotron grid voltage set point.

10. The method of claim 8 wherein adjusting the raster output scanner exposure set point comprises:

adjusting a raster output scanner power level set point.

11. The method of claim 7 wherein adjusting the marking engine actuator comprises:

adjusting an ink jet drop ejection voltage.

12. The method of claim 7 wherein adjusting the at least one marking engine actuator comprises:

adjusting a plurality of marking engine actuators of at least one of the first marking engine and the second marking engine.

13. The method of claim 12 wherein adjusting the plurality of marking engine actuators comprises:

adjusting an ROS exposure and a charging element voltage.

14. A method operative to control image consistency in an image rendering system that includes an image input device operative to generate a computer readable representation of an imaged item and a plurality of xerographic print engines operative to render printed images on print media based on the computer readable representation of the imaged item, the method comprising:

predetermining a test image;

printing a first rendered version of the test image on print media with a first xerographic print engine;

generating a first computer readable representation of the first rendered version of the test image with the image input device;

printing a second rendered version of the test image on print media with a second xerographic print engine;

generating a second computer readable representation of the second rendered version of the test image with the image input device;

determining image consistency information from the first computer readable representation and the second computer readable representation; and, adjusting at least one xerographic actuator of at least one of the first and second xerographic print engines in a manner predetermined to make an improvement in image consistency based on the determined image consistency information.

15. The method of claim 14 wherein determining image consistency information comprises:

determining a first lightness metric for at least a portion of the first computer readable representation;

determining a second lightness metric for at least a portion of the second computer readable representation;

comparing the first lightness metric to a target lightness associated with the predetermined test image, thereby determining a first difference between the first lightness metric and the target lightness; and, comparing the second lightness metric to the target lightness, thereby determining a second difference between the second lightness metric and the target lightness.

16. The method of claim 15 further comprising:

comparing a magnitude of the first difference to a magnitude of the second difference, thereby determining a larger of the first difference and the second difference magnitude, if both of the first difference and the second difference have magnitudes less than a predetermined acceptable magnitude; and adjusting at least one xerographic actuator of the xerographic print engine associated with the larger of the first difference magnitude or the second difference magnitude.

17. The method of claim 16 further comprising:

adjusting at least one xerographic actuator of each of the first xerographic print engine and the second xerographic print engine if the magnitude of at least one of the first difference and the second difference is greater than the predetermined acceptable magnitude.

18. The method of claim 14 wherein adjusting at least one xerographic actuator comprises:

adjusting a raster output scanner power.

19. The method of claim 14 wherein adjusting at least one xerographic actuator comprises:

adjusting a scorotron grid voltage.

20. The method of claim 19 further comprising:

adjusting a raster output scanner exposure.

21. The method of claim 14 wherein predetermining a test image comprises:

selecting a mid-tone test patch.

22. The method of claim 21 wherein selecting a mid-tone test patch comprises:

selecting a test patch intended to have an area coverage of about 50%.

23. A document processing system comprising:

an image input device operative to generate computer readable representations of imaged items;

a plurality of xerographic print engines, each xerographic print engine having at least one xerographic actuator;

a test patch generator operative to control each of the plurality of xerographic print engines to generate a printed version of a mid-tone test patch;

a test patch analyzer operative to analyze computer readable versions of a plurality of test patches generated by the image input device, the plurality of test patches being associated with respective ones of the plurality of xerographic print engines, and operative to determine an amount at least one of the xerographic actuators should be adjusted based on the analysis; and a xerographic actuator adjuster operative to adjust the at least one xerographic actuator according to the amount determined by the test patch analyzer.

24. The document processing system of claim 23 wherein the test patch analyzer is operative to determine an amount at least one xerographic actuator should be adjusted by analyzing a first computer readable version of at least a portion of a first test patch associated with a first xerographic print engine to determine a first lightness metric, analyzing a second computer readable version of at least a portion of a second test patch associated with a second xerographic print engine to determine a second lightness metric, comparing the first lightness metric to a target lightness associated with the predetermined test image, thereby determining a first difference between the first lightness metric and the target lightness, comparing the second lightness metric to the target lightness, thereby determining a second difference between the second lightness metric and the target lightness, and comparing a magnitude of the first difference and a magnitude of the second difference to a predetermined acceptable magnitude, and to adjust at least one xerographic actuator associated with the first xerographic print engine according to the magnitude of the first difference, and to adjust at least one xerographic actuator associated with the second xerographic print engine according to the magnitude of the second difference if at least one of the first difference magnitude and the second difference magnitude is above the predetermined acceptable difference magnitude, and to adjust at least one xerographic actuator associated with the larger of the first difference magnitude and the second difference magnitude if both the magnitude of the first difference and the magnitude of the second difference is less than that the predetermined acceptable difference magnitude.

25. The document processing system of claim 23 wherein the test patch analyzer is operative to determine an amount at least one xerographic actuator should be adjusted by analyzing a first computer readable version of at least a portion of a first test patch associated with a first xerographic print engine to determine a first lightness metric, analyzing a second computer readable version of at least a portion of a second test patch associated with a second xerographic print engine to determine a second lightness metric, comparing the first lightness metric to a target lightness associated with the predetermined test image, thereby determining a first difference between the first lightness metric and the target lightness, comparing the second lightness metric to the target lightness, thereby determining a second difference between the second lightness metric and the target lightness, and comparing a magnitude of the first difference and a magnitude of the second difference to a first predetermined acceptable magnitude, and to adjust at least one xerographic actuator associated with the first xerographic print engine according to the magnitude of the first difference, and to adjust at least one xerographic actuator associated with the second xerographic print engine according to the magnitude of the second difference if at least one of the first difference and the second difference is above the first predetermined acceptable difference magnitude, and to determine a magnitude of a third difference between the first difference and the second difference and adjust at least one xerographic actuator associated with the larger of the magnitude of the first difference and the magnitude of the second difference if both the magnitude of the first difference and the magnitude of the second difference are less than that the first predetermined acceptable difference magnitude and the third difference magnitude is greater than a second predetermined acceptable magnitude.

26. The document processing system of claim 23 wherein the xerographic actuator adjuster is operative to adjust at least one raster output scanner exposure.

27. The document processing system of claim 23 wherein the xerographic actuator adjuster is operative to adjust at least one charge grid voltage.

28. The document processing system of claim 23 wherein the xerographic actuator adjuster is operative to adjust at least a raster output scanner exposure and a charge grid voltage of at least one xerographic print engine.

29. A method operative to control image consistency comprising:

predetermining a test image;

printing a first rendered version of the test image on print media with a first marking engine of a plurality of marking engines;

generating a first computer readable representation of the first rendered version of the test image with an image input device;

printing a second rendered version of the test image on print media with a second marking engine of the plurality of marking engines;

generating a second computer readable representation of the second rendered version of the test image with the image input device;

determining image consistency information from the first computer readable representation and the second computer readable representation; and if necessary, adjusting at least one aspect of the image rendering system in a manner predetermined to achieve image consistency.

* * * * *